US009067456B2

(12) United States Patent
Barber et al.

(10) Patent No.: US 9,067,456 B2
(45) Date of Patent: Jun. 30, 2015

(54) FOLD AND PLAY GREETING CARD

(71) Applicants: Darren Barber, London (GB); Christian Eager, London (GB)

(72) Inventors: Darren Barber, London (GB); Christian Eager, London (GB)

( * ) Notice: Subject to any disclaimer, the term of this patent is extended or adjusted under 35 U.S.C. 154(b) by 0 days.

(21) Appl. No.: 13/912,411

(22) Filed: Jun. 7, 2013

(65) Prior Publication Data

US 2014/0360065 A1 Dec. 11, 2014

(51) Int. Cl.
*B42D 15/04* (2006.01)
*G09F 1/06* (2006.01)

(52) U.S. Cl.
CPC ..... *B42D 15/042* (2013.01); *B42D 15/045* (2013.01); *G09F 1/06* (2013.01)

(58) Field of Classification Search
CPC ..... G09G 1/06; G09G 1/08
USPC ..... 40/124.14
See application file for complete search history.

(56) References Cited

U.S. PATENT DOCUMENTS

| | | | | |
|---|---|---|---|---|
| 2,144,512 | A * | 1/1939 | Schwartz | 40/539 |
| 2,702,148 | A * | 2/1955 | Paasche | 223/68 |
| 2,704,910 | A * | 3/1955 | Paige | 446/388 |
| 2,743,862 | A * | 5/1956 | Paige | 206/773 |
| 3,090,144 | A * | 5/1963 | Malamude | 40/124.08 |
| 3,866,815 | A * | 2/1975 | Desmond | 229/116.1 |
| 4,462,178 | A * | 7/1984 | Freeman | 40/539 |
| 8,112,918 | B1 * | 2/2012 | Crowell et al. | 40/124.14 |
| 2003/0046840 | A1 * | 3/2003 | Evans et al. | 40/538 |
| 2010/0293823 | A1 * | 11/2010 | Hsu | 40/124.191 |

* cited by examiner

*Primary Examiner* — Gary Hoge
(74) *Attorney, Agent, or Firm* — Peter D. Aufrichtig; McCarthy Fingar LLP

(57) ABSTRACT

A two dimensional die cut greeting card with sections of the greeting card die cut and creased so that they can be removed from the card without the need for scissors or other cutting tools and which can be assembled by folding and engaging the die cut sections without the need for tape, glue or other connectors into a three dimensional object. A two dimensional message delivery system is convertible into a three dimensional object.

9 Claims, 17 Drawing Sheets

FOLD AND PLAY GREETING CARD

BACKGROUND OF THE INVENTION

This application claims the benefit of U.S. Provisional Application Ser. No. 61/656,780, filed Jun. 7, 2012.

The invention is generally related to greeting cards including die cut pieces which are designed to be easily and quickly removed from the greeting card by hand and without the need for scissors or other cutting tools, and assembled into a three dimensional toy or other object. The greeting card industry has included a constant effort to add value and interest to greeting cards beyond the initial reading of a new card. One desire is to provide a greeting card which can become a functional article without the need for glue, tape, staples or other connectors. Accordingly, an improved greeting card including die cut and pre-folded structures is provided, which allows the user to easily remove the components of a toy from the plain card and assemble them without tools, connectors or tape into a three dimensional toy.

SUMMARY OF THE INVENTION

The invention is generally directed to a two dimensional card with die cut or similarly separable components within the two dimensional card which are designed to be removed from the two dimensional card and folded and interlocked in a fashion to create a three dimensional toy or other object without the need for glue, tape or other connectors.

The invention is also generally directed to a two dimensional message delivery system convertible to a three dimensional object including: a two dimensional message delivery element; a main two dimensional structural element die cut from the two dimensional message delivery element and separable with the application of pressure; at least one auxiliary two dimensional structural element die cut from the two dimensional message delivery element and separable with the application of pressure, which connects with the main two delivery dimensional structural element to form a three dimensional object; a two dimensional message delivery element die cut from the two dimensional message delivery element and separable with the application of pressure, which connects with the main two dimensional structural element to provide a messaging element to the three dimensional object; whereby the two dimensional message delivery element can be converted to a three dimensional object with messaging delivery without the need for scissors, tape or glue.

The invention is also directed to the two dimensional message delivery system wherein the main two dimensional structural element, at least one auxiliary two dimensional elements and the two dimensional message delivery element are die cut from the two dimensional message delivery element but still partially connected until separated by the application of force to the main two dimensional structural element, at least one auxiliary two dimensional elements and the two dimensional message delivery element to separate these elements from the two dimensional message delivery element and each other.

Accordingly, it is an object of the invention to provide an improved two dimensional card suitable for being converted into a three dimensional toy or other object.

Still another object of the invention is to provide an improved die cut two dimensional card in which components that are die cut can be removed and folded to form a three dimensional toy or object from the two dimensional components.

Yet a further object of the invention is to provide an improved greeting card which becomes a three dimensional object without the need for tape, glue or other connective members.

Still a further object of the invention is to provide an improved multi-purpose two dimensional message delivery system which can convert to a three dimensional playable object.

Yet still a further object of the invention is to provide an improved flat message delivery system which is convertible to a three dimensional object for play and augmented message delivery Still other objects and advantages of the invention will, in part, be obvious and will, in part, be apparent from the specification.

The invention accordingly comprises the features of construction, combinations of elements and arrangements of part and processes which will be exemplified in the constructions and processes as hereinafter set forth, and the scope of the invention will be indicated in the claims.

BRIEF DESCRIPTION OF THE DRAWINGS

The present invention will now be described in more complete detail with frequent reference being made to the figures identified below.

DETAILED DESCRIPTION OF THE PREFERRED EMBODIMENTS

Figure 2:
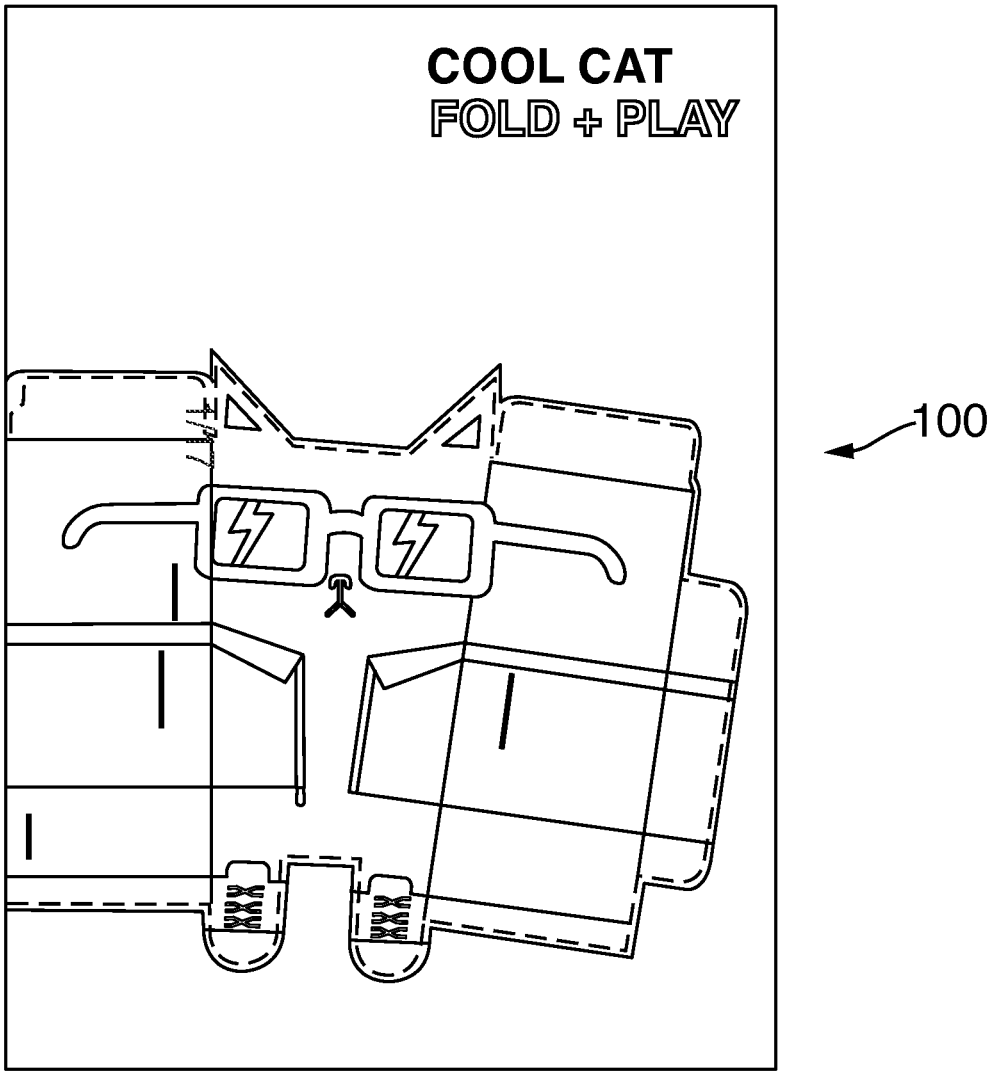
FIG. 2 is a top plan view of a greeting card in accordance with a first preferred embodiment of the invention.
Figure 3:
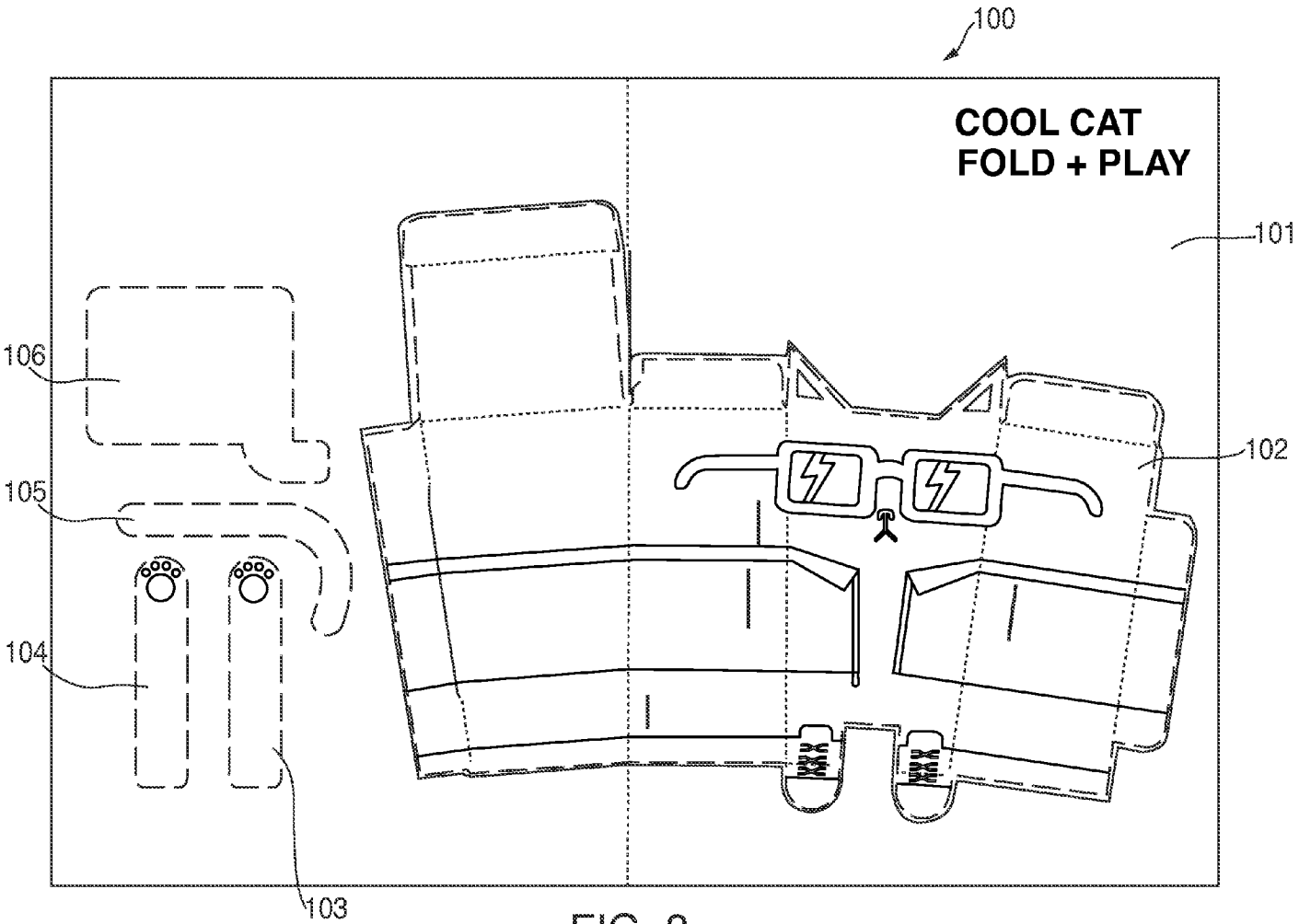
FIG. 3 is a top plan view of the greeting card of FIG. 1 laid open and flat.
Figure 4:
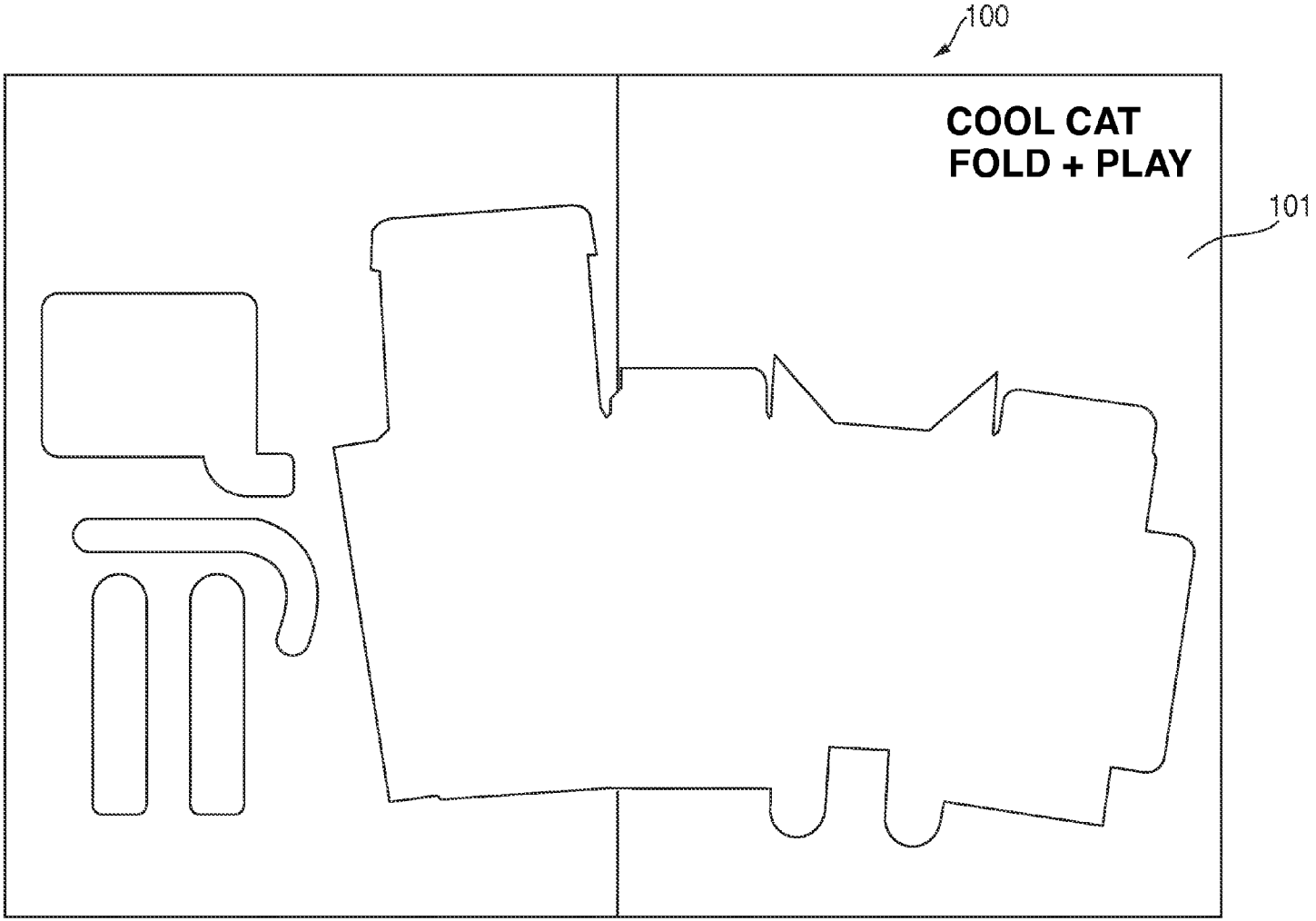
FIG. 4 is a top plan view of the greeting card of FIGS. 1 and 2 in which the die cut components have been removed from the two dimensional card.

Reference is made to FIGS. 1-15, which highlight a first preferred embodiment of the invention. FIG. 3 shows a greeting card 100 flattened out with the background portion 101, die cut main body element 102, arm segments 103 and 104, tail component 105 and message bubble portion 106. FIG. 2 shows greeting card 100 in its usual presentation form, folded in half.

Figure 1:
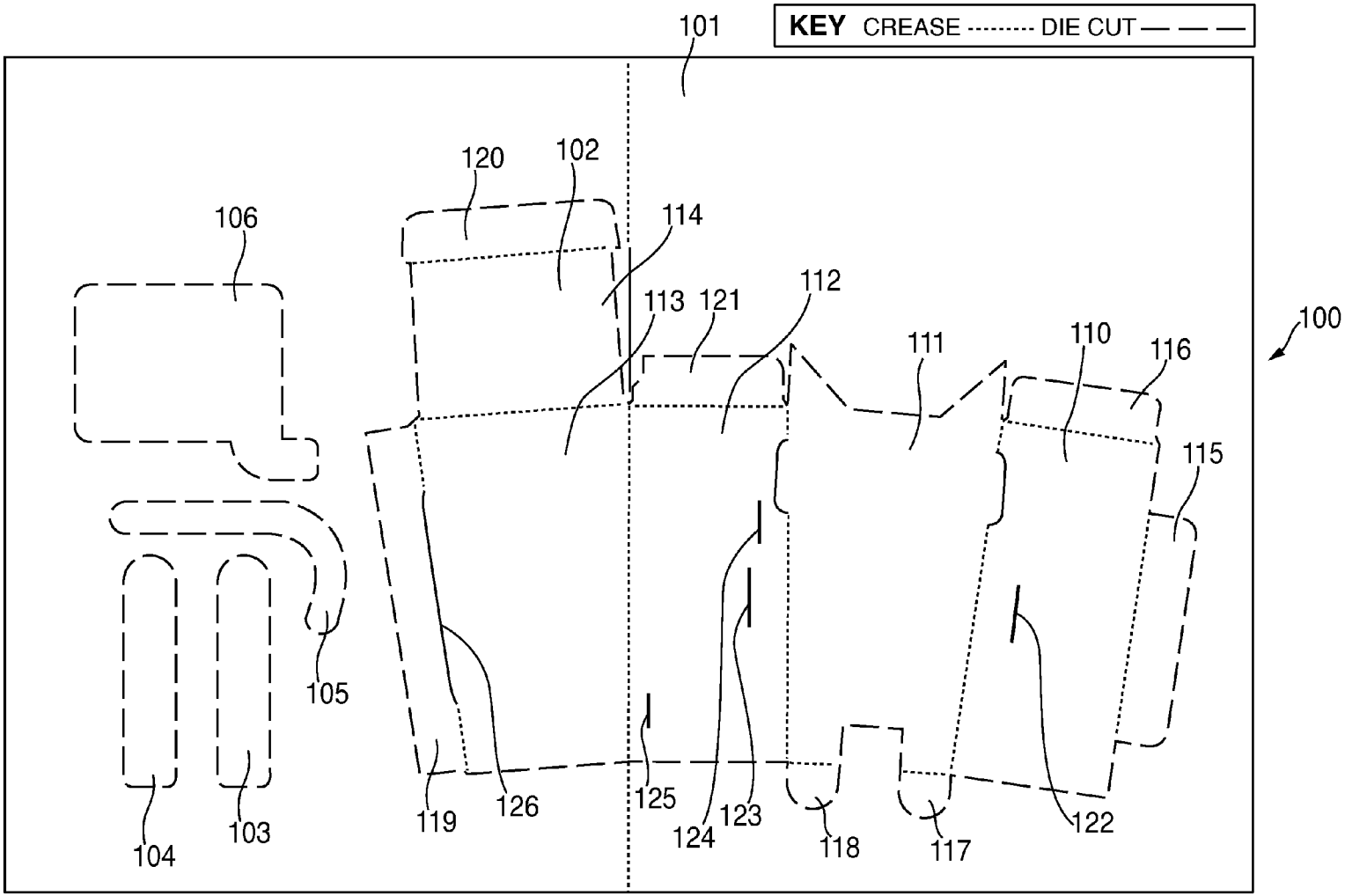
FIG. 1 is a top plan view of a sheet designed for use as a greeting card in accordance with the invention.
Figure 5:
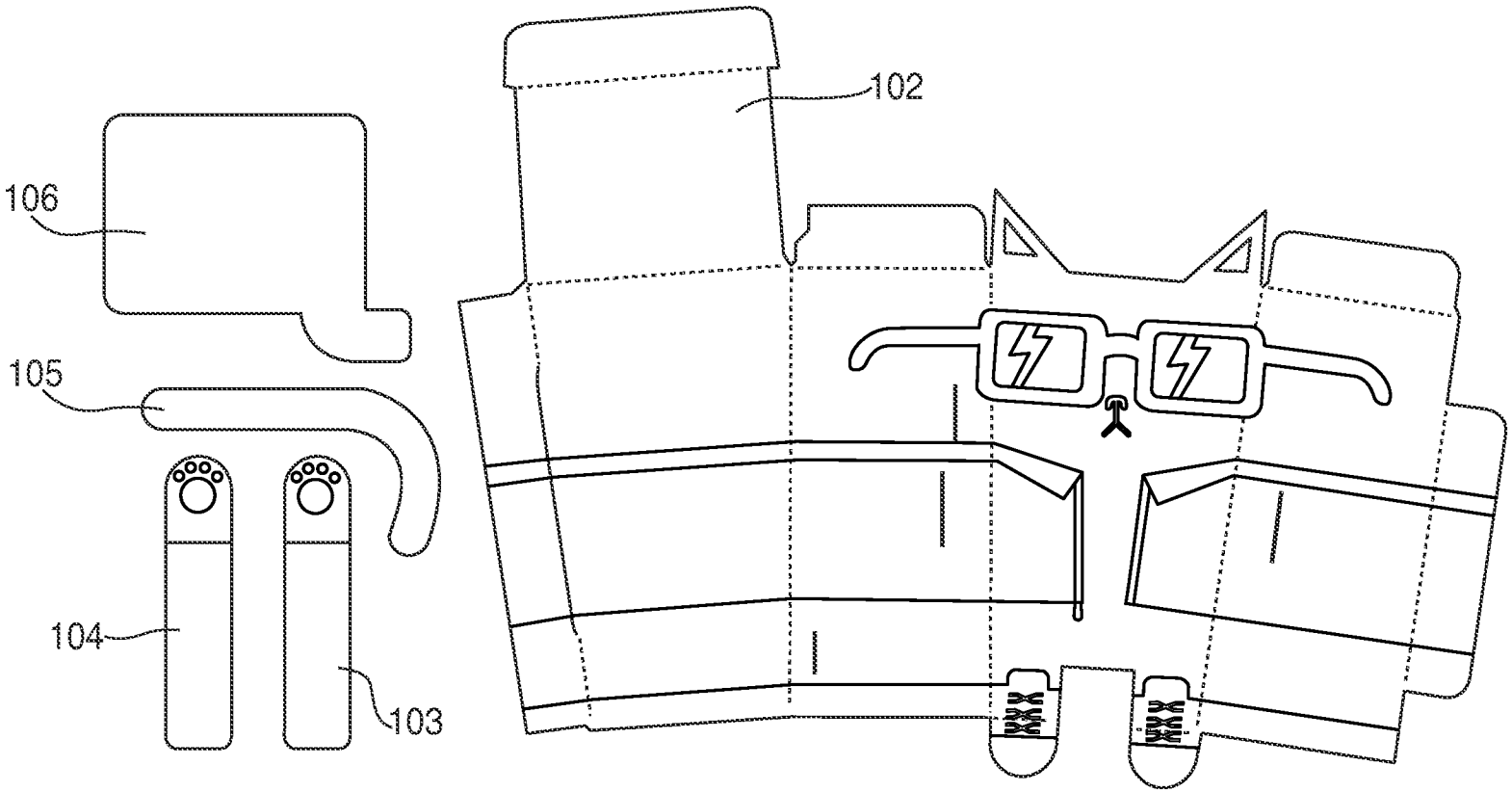
FIG. 5 is a top plan view of the die cut components which have been removed from the greeting card of FIG. 1.

Reference is next made to FIG. 1 wherein greeting card 100, without the design element showing in the embodiment of FIG. 1, a cool cat wearing sunglasses is shown. The drawing of FIG. 1 identifies the elements in FIG. 1, including the portions of the figures which are cut with either a crease or a die cut as shown in the key portion. The greeting card 100 includes a backing portion 101 which is the two dimensional message delivery element, which supports the various die cut elements 102, 103, 104, 105 and 106. Die cut element 102 which is the main two dimensional structural element forms the main body of the three-dimensional object which can be formed. Arms 103 and 104, tail 105 and message balloon 106, which are the two dimensional auxiliary structural elements, form the other die cut elements, each of which can be separated from the backing portion 101 as seen in FIG. 5, where these elements are shown freed from the backing portion 101 but still in two-dimensional form.

Main body 102 includes panels 110, 111, 112, 113 and 114, which are separated by creased divisions as shown in FIG. 1. In addition, tabs 114, 115, 119, 120 and 121 are used to assist in the assembly of the two-dimensional main body 112 into a three-dimensional object. Flaps 117 and 118 are used to create the feet of the three-dimensional object. In addition, slots 122, 123, 124 and 125 are used to assemble the other elements of the three-dimensional object, that is, arms 103, 104, tail 105 and message balloon 106 onto the main body of the object 102.

Figure 6:
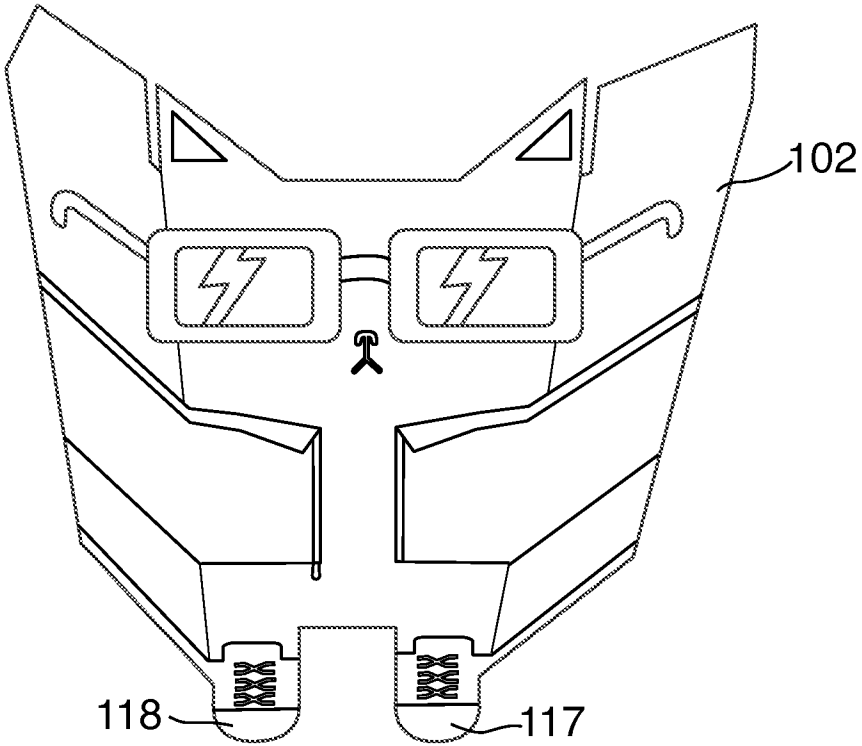
FIG. 6 is a perspective view of the die components of the card of FIG. 1 partially assembled.
Figure 7:
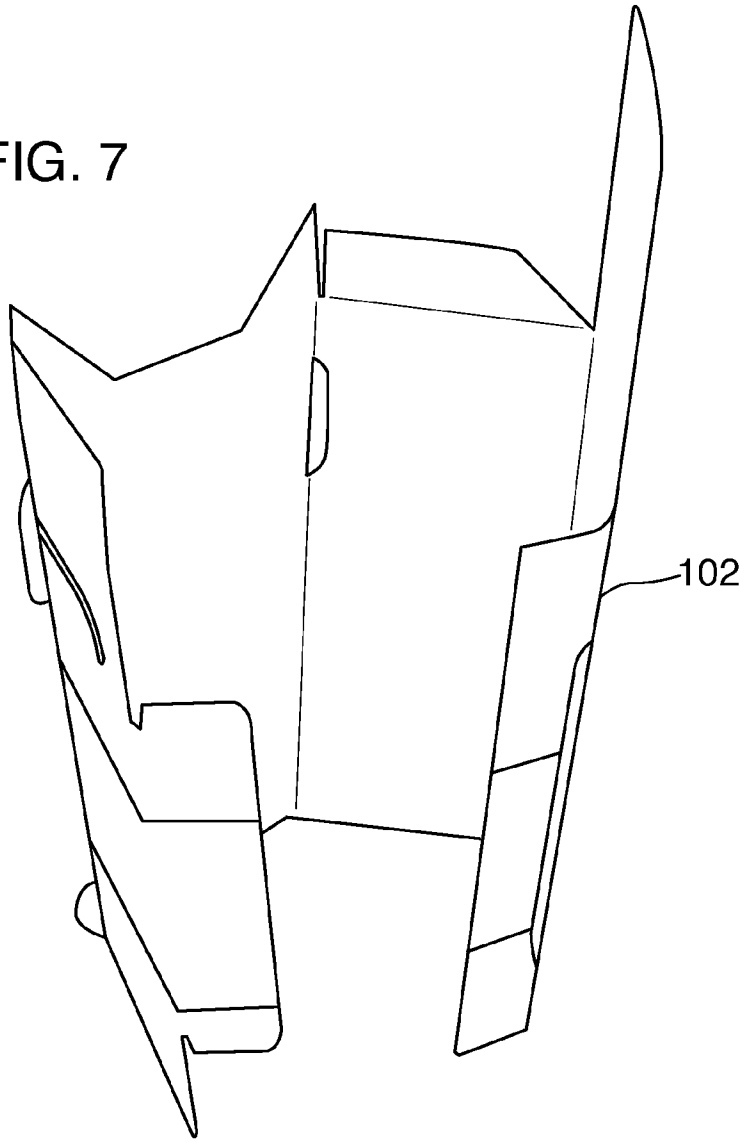
FIG. 7 is a perspective view of the die components of the card of FIG. 1 partially assembled.
Figure 8:
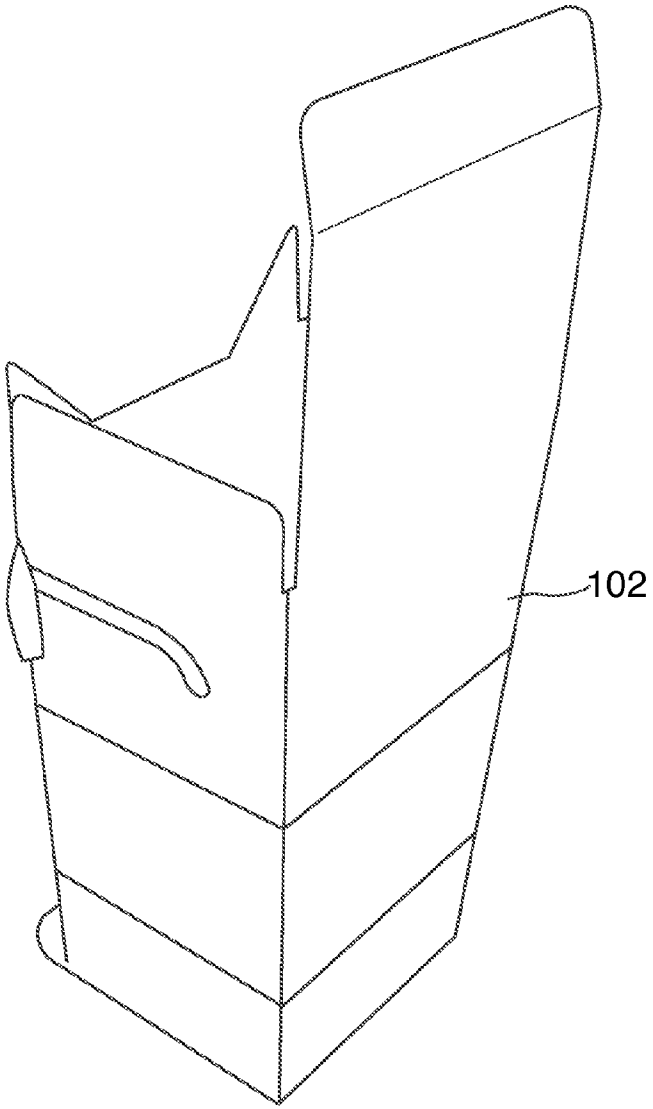
FIG. 8 is a perspective view of the die components of the card of FIG. 1 partially assembled from the assembly state of FIG. 7.

The assembly of the three-dimensional object from the die cut elements is shown in FIGS. 6-14. In FIG. 6 the feet portions 117, 118 are folded along the crease lines connecting them to central section 111 and the main panels 110, 111, 112 and 113 are creased so as to begin to form the piece 102 into an enclosed three-dimensional object. FIG. 7 shows essentially the same state as FIG. 6 but from a different perspective. FIG. 8 shows the main portion of the object 102 assembled into a four sided structure held together partially by tab 115 extending into the slot 126 at the edge of panel 113. In addition, at this point top panel 102 and top flaps 114 and 121 are still in a vertical or unfolded orientation.

Figure 9:
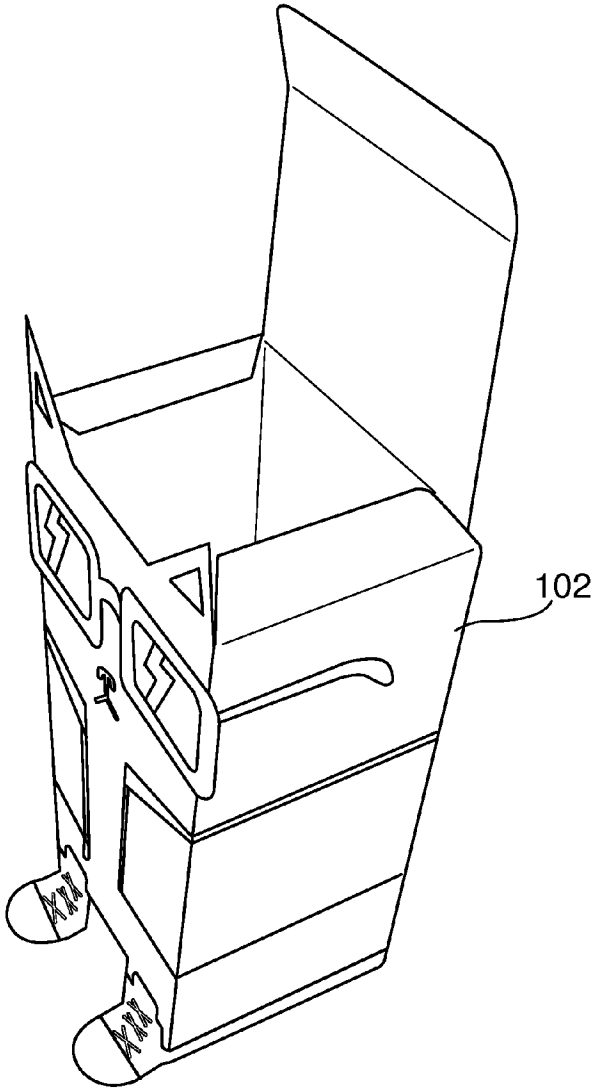
FIG. 9 is a perspective view of the die components of the card of FIG. 1 partially assembled from the assembly state of FIG. 8.
Figure 10:
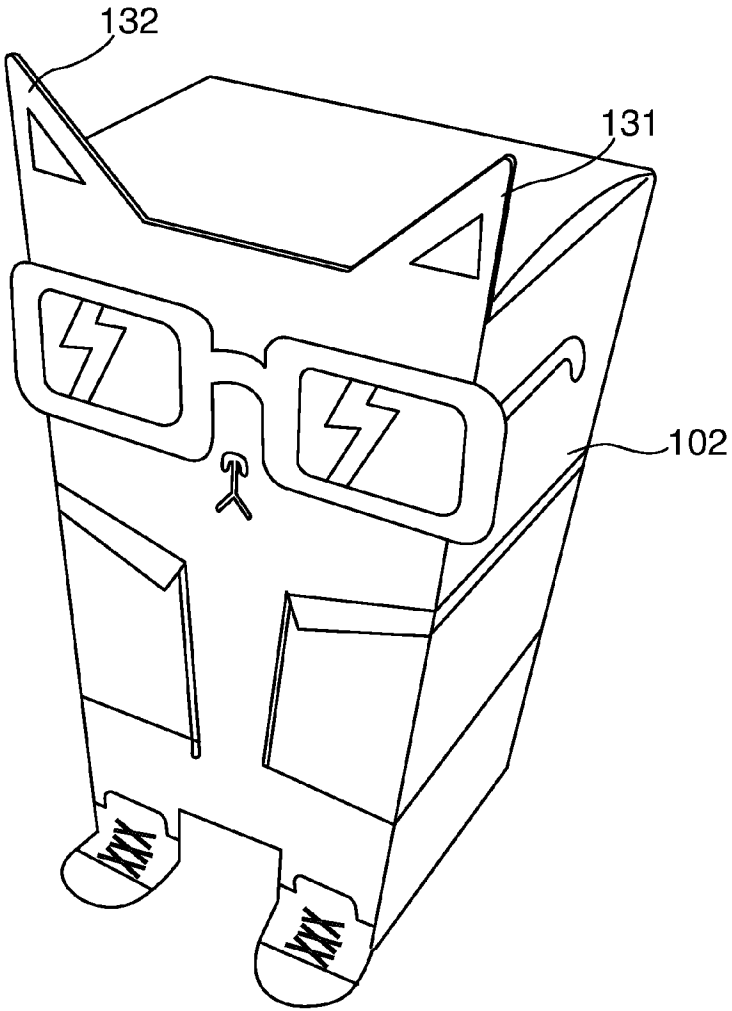
FIG. 10 is a perspective view of the die components of the card of FIG. 1 partially assembled from the assembly state of FIG. 9.
Figure 11:
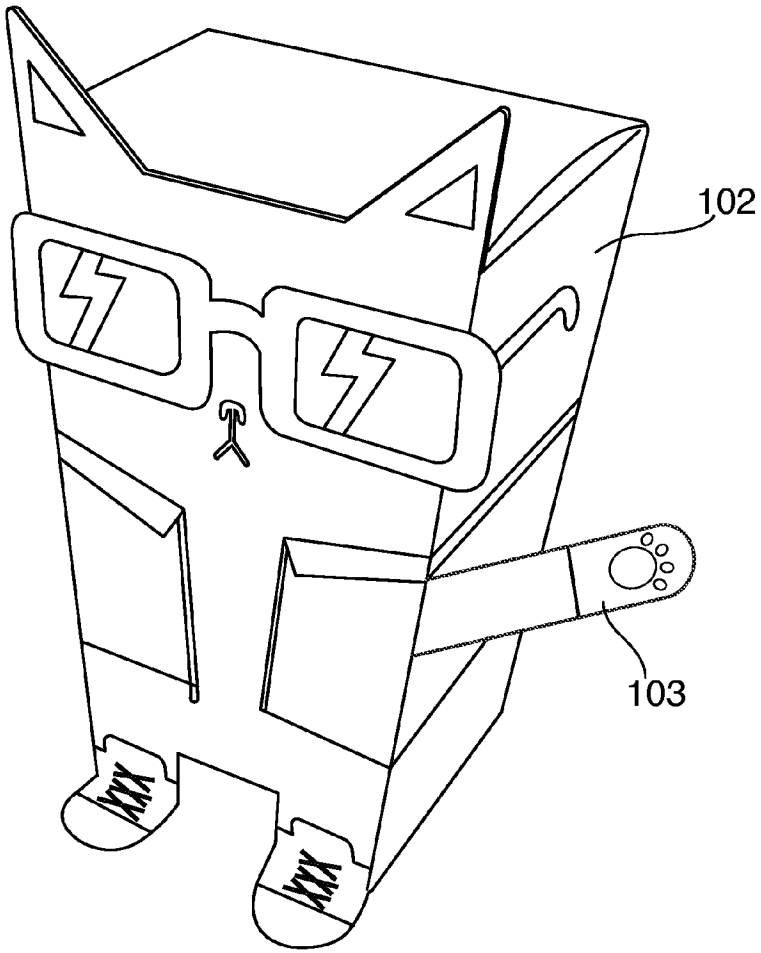
FIG. 11 is a perspective view of the die components of the card of FIG. 1 partially assembled from the assembly state of FIG. 10.
Figure 12:
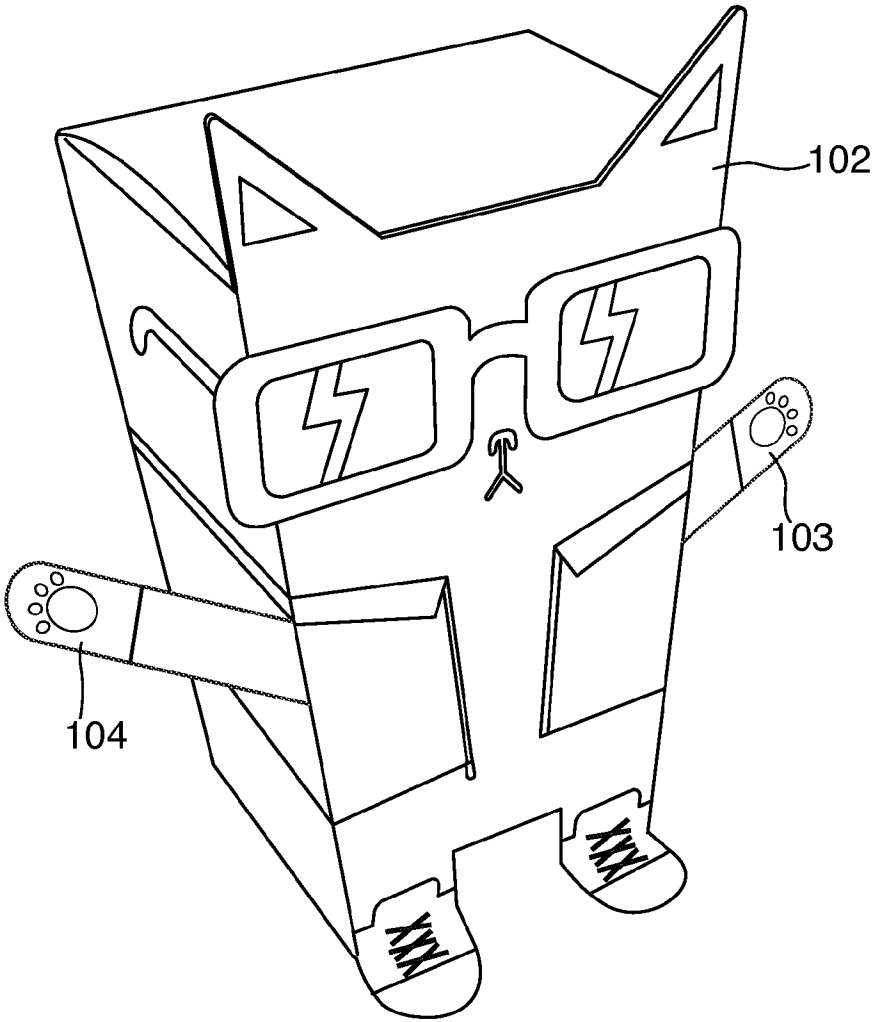
FIG. 12 is a perspective view of the die components of the card of FIG. 1 partially assembled from the assembly state of FIG. 11.
Figure 13:
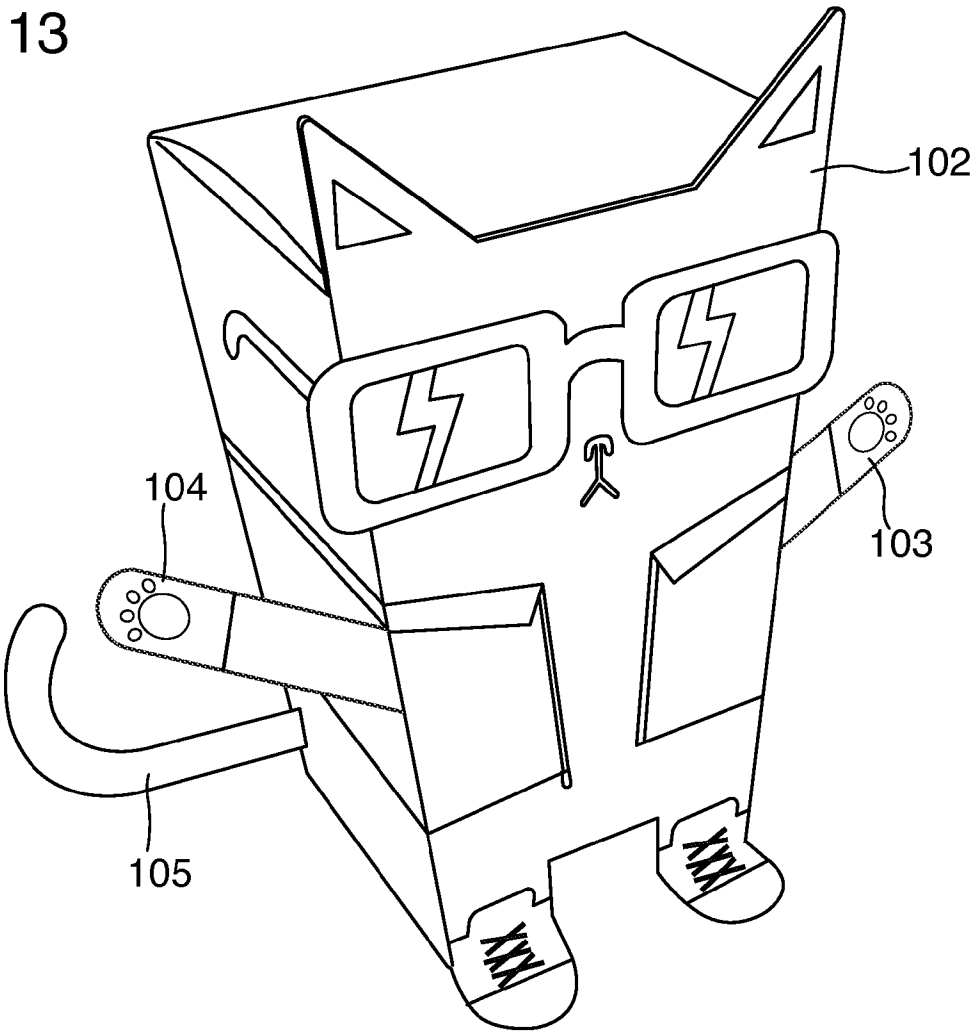
FIG. 13 is a perspective view of the die components of the card of FIG. 1 partially assembled from the assembly state of FIG. 12.
Figure 14:
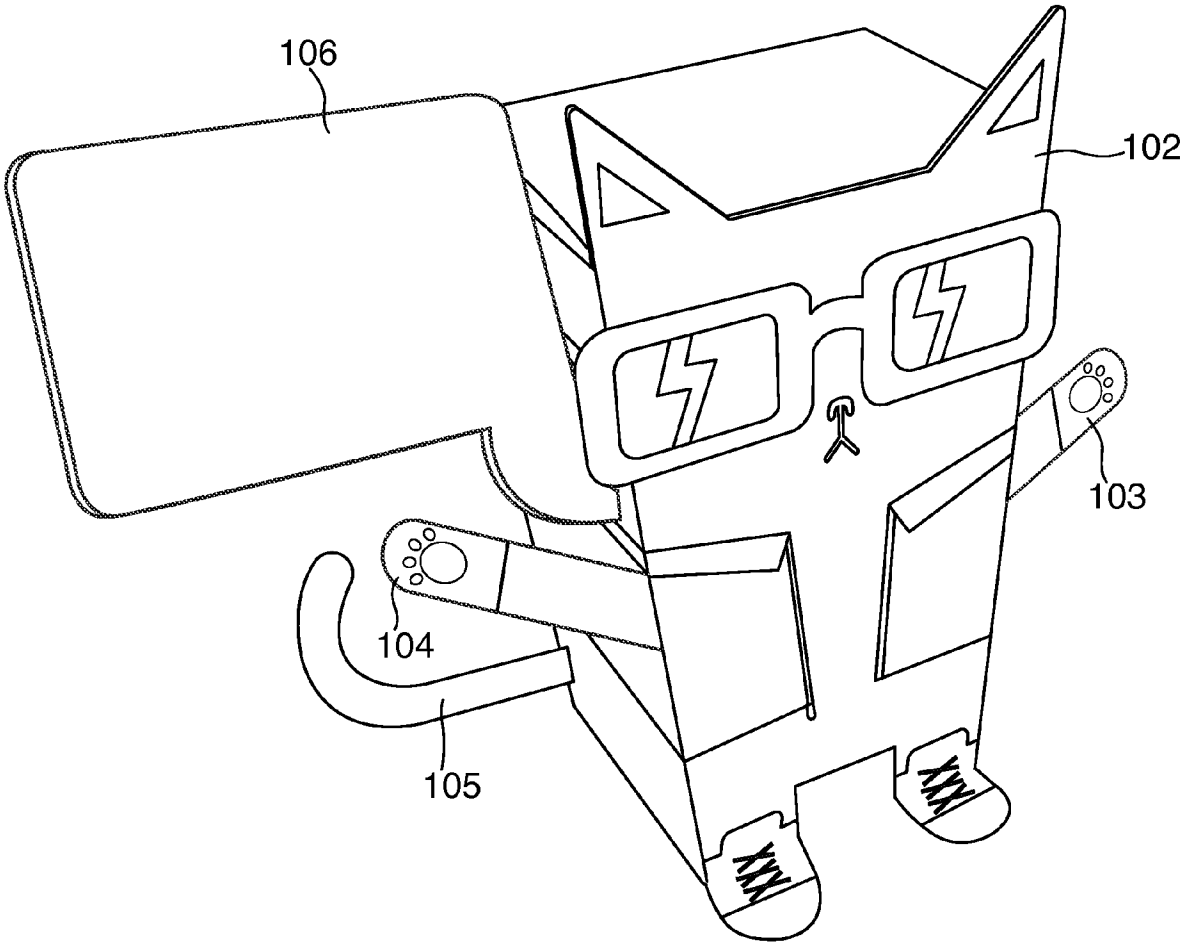
FIG. 14 is a perspective view of the die components of the card of FIG. 1 assembled to completion from the assembly state of FIG. 13.
Figure 15:
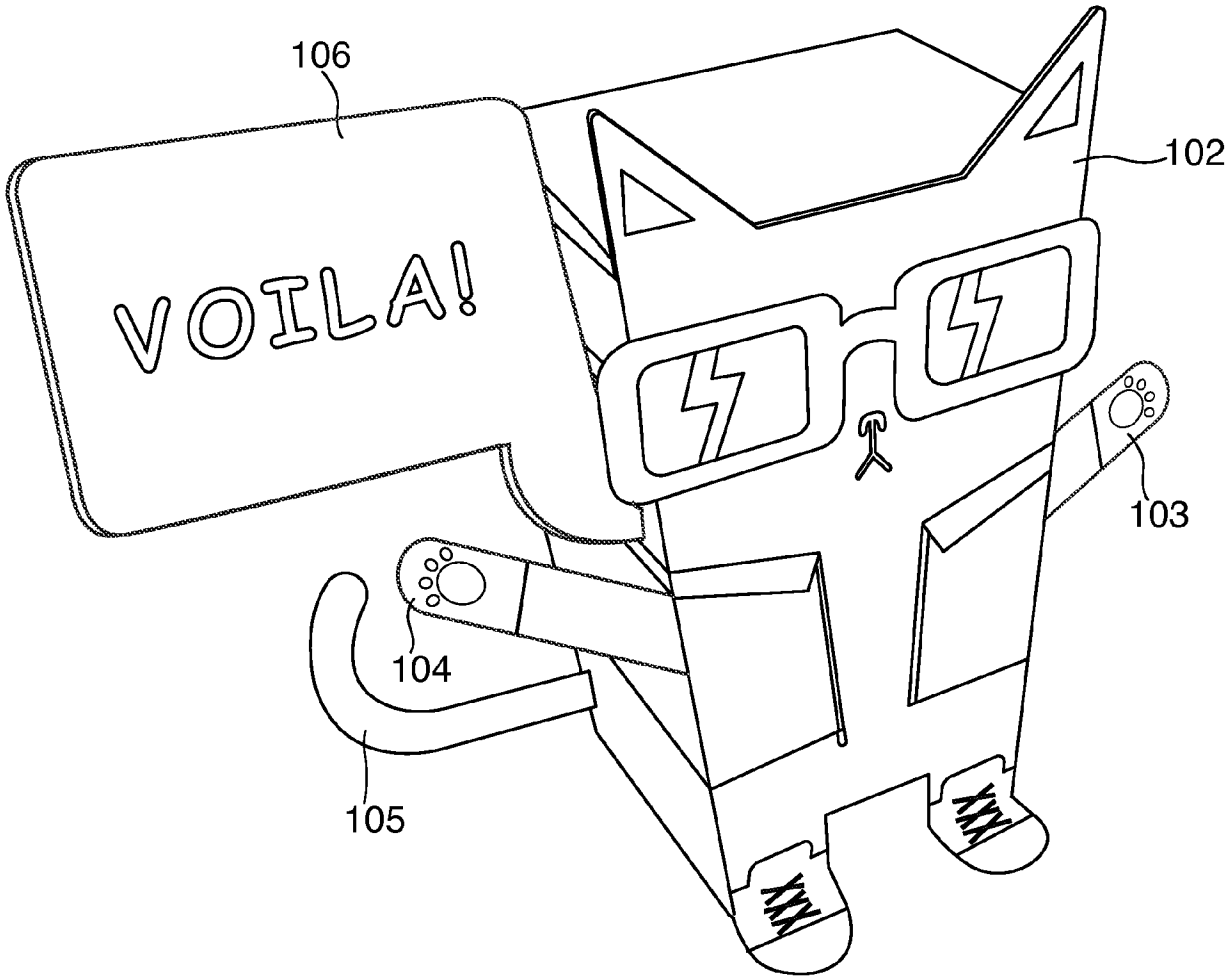
FIG. 15 is a perspective view of the die components of the card of FIG. 1 assembled to completion and including a message.

Next, in FIG. 9, the top side panels 114 and 121 are bent downwardly and in FIG. 10 the end flap 120 is folded down at the end of panel 114, which is then inserted against the back of panel 111 to form a closed top with ears 131, 132 apparently extending upwardly at the front of object 102. In FIG. 11, arm 103 is placed in slot 122. In FIG. 12, arm 104 is placed in slot 123. In FIG. 13, tail 105 is placed in slot 125 and, finally, in FIG. 14, message balloon 106 is placed in slot 124. In FIG. 15 a message has been written on message balloon 106 to create the finished object.

Figure 16:
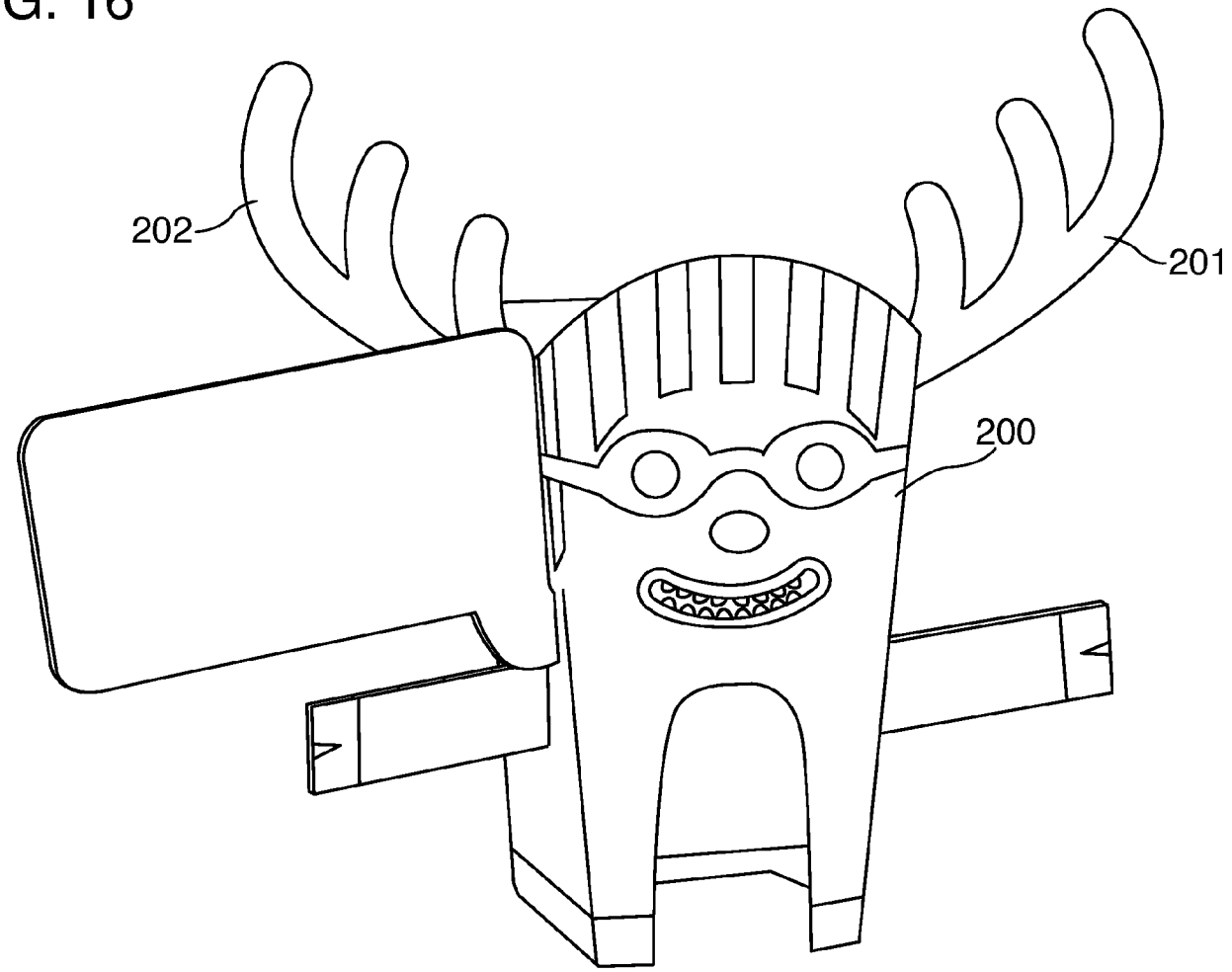
FIG. 16 is a perspective view of a fully assembled die cut toy formed from the die cut sections of a greeting card in accordance with another embodiment of the invention.
Figure 17:
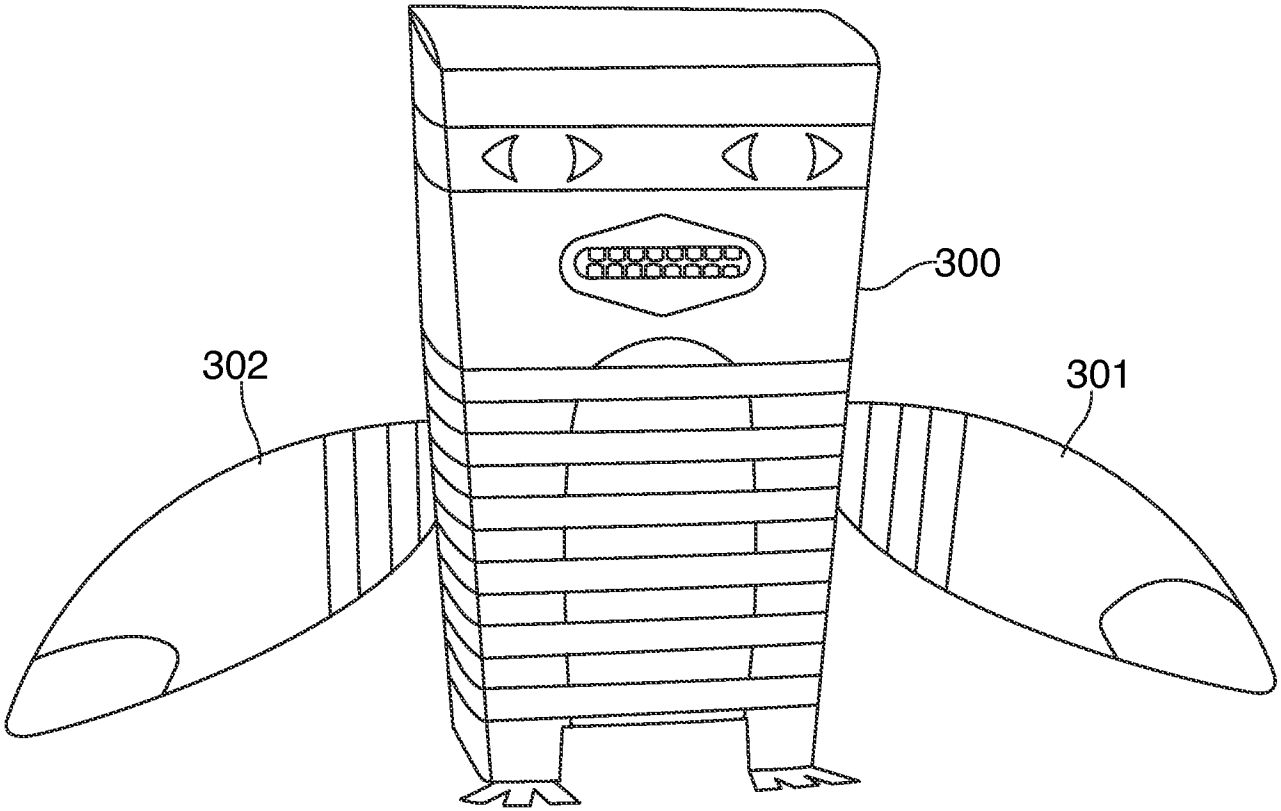
FIG. 17 is a perspective view of a fully assembled die cut toy formed from the die cut portions of a greeting card in accordance with yet another embodiment of the invention.

While the three dimensional object shown is that of a cat with arms, legs and a tail, other types of images can be formed with the same or similar features. For example, in FIG. 16, a moose 200 is shown. Rather than including a tail 105, as in the embodiment of FIGS. 1-15, the moose 200 includes antlers 201, 202 at the top, which can be connected utilizing similar slots in the main body of moose 200. Similarly, as shown in FIG. 17, a bird 300 can be shown with wings 301 and 302.

The message bubble which is added to each of the various figures which can be formed from the die cut components of the greeting cards comes generally in a blank form which can be filled in either by the person giving the card or by the person receiving it to personalize their three-dimensional toy.

The visual images can be changed depending upon the needs of the toy displayed and other designs can be developed in accordance with the invention.

Note that the greeting card flat component shows that the die cut sections have die cuts which separate the cardboard from adjacent sections and crease lines which allow the toy to fold along the pre-formed crease lines.

Accordingly, a wide variety of toys and forms as three dimensional objects from the flat, die cut greeting card can be made.

Greeting cards are designed with folds, slits and shapes which allow the two dimensional die cut sections of the greeting card to be formed into a three dimensional toy with various add-ons such as arms, lets, tails, heads and word bubbles structured so as to fit into the body of the three dimensional toy. Each of the designs includes a blank word bubble or similar messaging element which can be personalized either by the person sending the card or by the person receiving the card to create a message along with the toy. The message bubble can be included in the final toy or not as the recipient chooses.

Accordingly, an improved greeting card formed with die cut sections is provided which allows the die cut sections to be removed from the greeting card and then folded and assembled without the use of tape, glue or other connectors into a three dimensional toy or other object.

The invention is also generally directed to a two dimensional message delivery system convertible to a three dimensional object including: a two dimensional message delivery element; a main two dimensional structural element die cut from the two dimensional message delivery element and separable with the application of pressure; at least one auxiliary two dimensional structural element die cut from the two dimensional message delivery element and separable with the application of pressure, which connects with the main two delivery dimensional structural element to form a three dimensional object; a two dimensional message delivery element die cut from the two dimensional message delivery element and separable with the application of pressure, which connects with the main two dimensional structural element to provide a messaging element to the three dimensional object; whereby the two dimensional message delivery element can be converted to a three dimensional object with messaging delivery without the need for scissors, tape or glue.

The invention is also directed to the two dimensional message delivery system wherein the main two dimensional structural element, at least one auxiliary two dimensional elements and the two dimensional message delivery element are die cut from the two dimensional message delivery element but still partially connected until separated by the application of force to the main two dimensional structural element, at least one auxiliary two dimensional elements and the two dimensional message delivery element to separate these elements from the two dimensional message delivery element and each other. The two dimensional message delivery system is illustrated in a fashion where the three dimensional object resembles an animal, a person, a vehicle, a robot or other object when assembled with appropriate limbs, tails, horns or antlers or similar identifying features.

It will thus be seen that the objects set forth above, among those made apparent in the preceding description, are efficiently obtained, and, since certain changes may be made in the above construction without departing from the spirit and scope of the invention, it is intended that all matter contained in the above description or shown in the accompanying drawings shall be interpreted as illustrative, and not in a limiting sense.

It is also understood that the following claims are intended to cover all of the generic and specific features of the invention herein described and all statements of the scope of the invention, which, as a matter of language, might be said to fall therebetween.

What is claimed is:

1. A two dimensional message delivery system convertible to a three dimensional object, comprising:

a two dimensional message delivery element;

a main two dimensional structural element die cut from the two dimensional message delivery element and separable with the application of pressure and the main two dimensional structural element includes four main panels with creasing between each to form four vertically oriented sides of the three dimensional object;

at least one auxiliary two dimensional structural element die cut from the two dimensional message delivery element and separable with the application of pressure, which connects with the main two delivery dimensional structural element to form a three dimensional object;

a two dimensional message delivery element die cut from the two dimensional message delivery element and separable with the application of pressure, which connects with the main two dimensional structural element to provide a messaging element to the three dimensional object;

and the main two dimensional structural element includes at least one tab and one slot which ioins the four main anels into a ferlerally rectanaular solid body and further includes a top panel which bends doviinwardly to close the top of the generally rectangular solid body and also includes a top panel flap and two top side flaps which lock the top panel closed against the four main panels of the main two dimensional structural element whereby the two dimensional message delivery element can be converted to a three dimensional object with messaging delivery without the need for scissors, tape or glue.

2. The two dimensional message delivery system of claim 1 wherein the main two dimensional structural element, at least one auxiliary two dimensional elements and the two dimensional message delivery element are die cut from the two dimensional message delivery element but still partially connected until separated by the application of force to the main two dimensional structural element, at least one auxiliary two dimensional elements and the two dimensional message delivery element to separate these elements from the two dimensional message delivery element and each other.

3. The two dimensional message delivery system of claim 1 wherein the main two dimensional structural element further includes at least one lower flap which is foldable to form feet for the three dimensional object when the four main panels are joined into the generally rectangular solid body.

4. The two dimensional message delivery system of claim 1 wherein the main two dimensional structural element further includes at least two slits, at least one of which is intended to receive a tab in the at least one auxiliary two dimensional structural element, and one slit is intended to receive a tab in the two dimensional message delivery element.

5. The two dimensional message delivery system of claim 4 wherein the main two dimensional structural element further includes die cutting of at least one of the main panels of the two dimensional structural element to form upward projections which act as ears or similar design elements in the finished three dimensional object and further act to lock the top panel against the four main panels.

6. The two dimensional message delivery system of claim 1 wherein the main two dimensional structural element is a die cut section which is foldable and engageable so as to form a three dimensional object.

7. The two dimensional message delivery system of claim 1 wherein the at le.ast one auxiliary two dimensional element includes two arm sections and a tail section.

8. The two dimensional message delivery system of claim 1 wherein the three dimensional object is a representation of a person or animal.

9. The two dimensional message delivery system of claim 1 wherein the three dimensional object is a representation of a robot or a vehicle.

* * * * *